United States Patent [19]

Krakauer et al.

[11] 3,940,810

[45] Mar. 2, 1976

[54] BOX SPRING, BOX SPRING FRAME AND MAKING SAME

[75] Inventors: Daniel Krakauer, Great Neck; C. Leonard Krakauer, Roslyn Heights, both of N.Y.

[73] Assignee: Kay Manufacturing Corporation, Syosset, N.Y.

[22] Filed: Nov. 21, 1974

[21] Appl. No.: 525,946

[52] U.S. Cl. ..... 5/241; 5/200 R

[51] Int. Cl.[2] ..... A47C 23/08; A47K 13/10

[58] Field of Search ..... 5/239, 241, 263, 264 R, 5/265, 2, 264 B, 200 R, 200 C

[56] References Cited

UNITED STATES PATENTS

| | | | |
|---|---|---|---|
| 2,997,723 | 8/1961 | Nicassio | 5/2 |
| 3,080,576 | 3/1963 | Cervisi | 5/264 |
| 3,628,201 | 12/1971 | Krakauer | 5/241 |
| 3,633,226 | 1/1972 | Krakauer | 5/265 |
| 3,783,459 | 1/1974 | Piliero | 5/263 |

*Primary Examiner*—Robert L. Wolfe
*Assistant Examiner*—Andrew M. Calvert
*Attorney, Agent, or Firm*—Harry Jacobson

[57] ABSTRACT

The box spring and box spring structure include a versatile frame made at appreciably lesser expense than presently known frames of equal rigidity and light weight. End rails of rectangular cross section carry no springs and are arranged completely underneath and overlap the side rails at the frame corners. All the rails have upper surfaces planar throughout their widths, those of the end rails being in secured engagement with the lower wide faces of the side rails at the frame corners to dispense with braces. The cross slats are parallel to each other and spaced any desired distances apart, equal or unequal. The end slats which carry the end rows of springs are arranged in close proximity to the respective end rails and are spaced above the end rails while extending inwardly enough in width to locate said spring rows in the proper position for upholstering. However, each end slat is securely connected to the end rail adjacent thereto by a longitudinal brace inserted between said end rail and said end slat and constituting the end part of the box spring frame. The brace, end rail and slat cooperate to form a self- reinforcing and self supporting structural unit, the members of which mutually transfer stresses between them. The brace so connected is intended to change the nature of the stresses to which the end parts of box springs have heretofore been subjected. The end portion of the box spring consequently is made capable of supporting unusually heavy loads concentrated on relatively small areas of said end portion. The frame is assembled upside down without rehandling and then righted if the springs have previously been attached to the slats to form the box spring structure or for the attachment of springs if needed and final upholstering.

12 Claims, 12 Drawing Figures

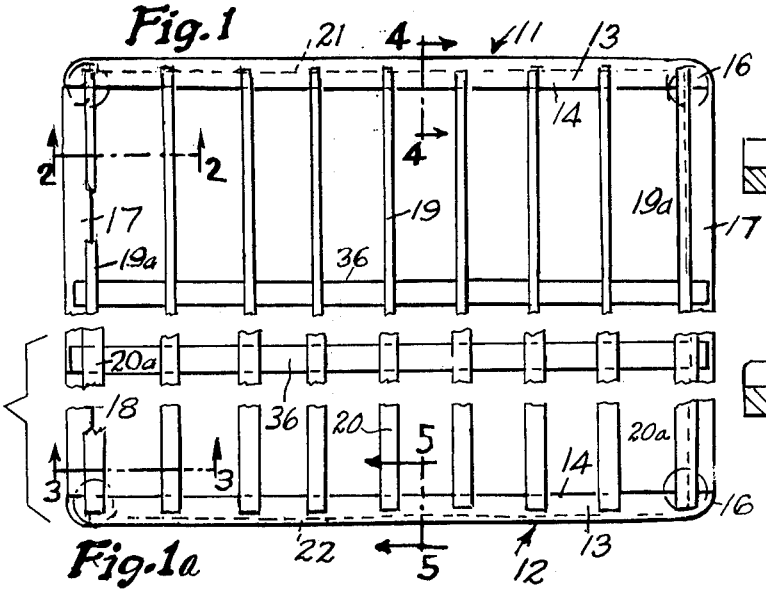
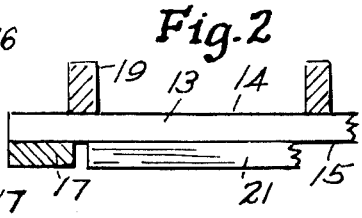
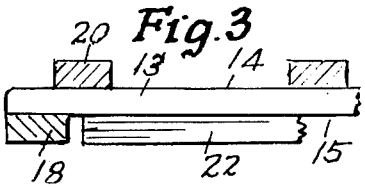
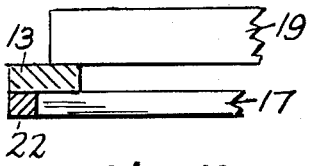
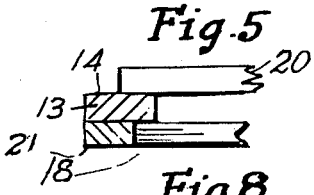
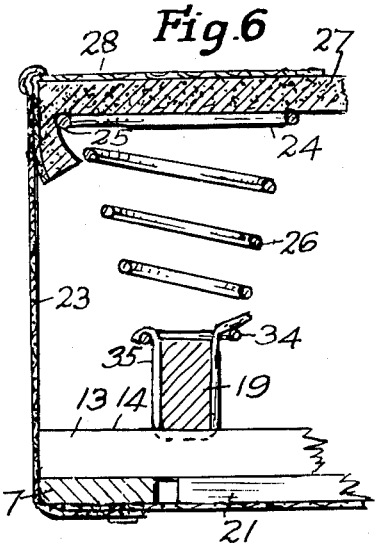
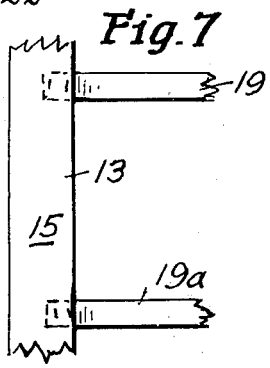
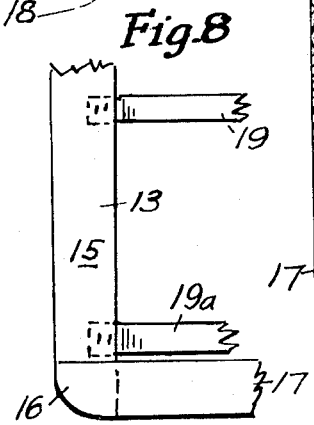
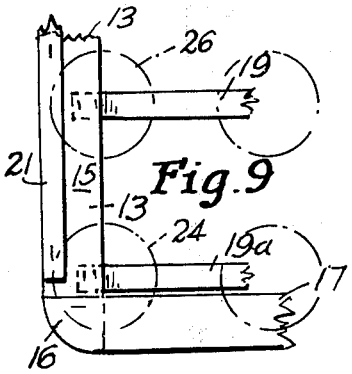
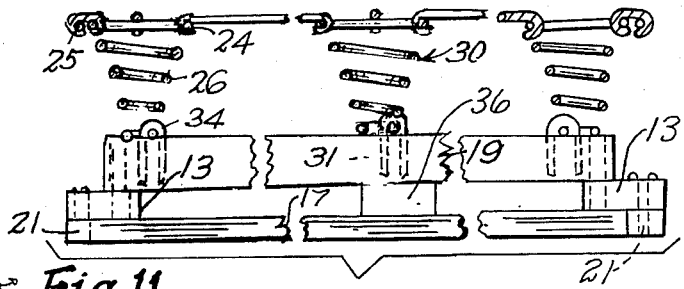
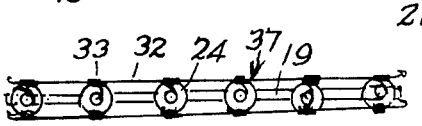
Fig.11

BOX SPRING, BOX SPRING FRAME AND MAKING SAME

This invention relates to box springs for bedding and particularly to the arrangement and relative proportions of the structural elements of box spring frames and also relates to the method of assembling and securing said elements to form box spring structures and of finishing the structures to form box springs.

The invention is an improvement over U.S. Pat. No. 3,628,201 to D. Krakauer to which reference is made for a description of the state of the prior art relating to box springs and which describes the rails and cross beams ("slats" herein) constituting the frames of most box springs.

However, the framing and upholstering units disclosed in said patent may involve or require relatively costly special shapes or labor or both for the corner joints as well as corner braces other than the end rails; or require oblique cutting off of the upper corner material of the slats to attain good nailing when the slats are set edgewise or vertically; or may require making such slats fully as long as the overall width of the frame.

While retaining the advantages of the framing units disclosed in said patent, the amount of material and labor and consequently the costs and weights of said framing units have been still further lowered by the present invention, though the strength and rigidity of the frames or framing units have been increased to make the end portion of the box spring structure self-reinforcing and substantially self-supporting and rigid enough adequately to support loads much greater than has been possible, without damage, by previous frame assemblies of parts of about the same dimensions. This result has been accomplished by so interconnecting the end slat and the end rail adjacent thereto as to form a mutually reinforcing and stress transferring structural unit of the connected members. The frames have also been made so versatile that they are usable in box springs of any practical degree of firmness or overall height and with lumber involving a wide range of dimensional tolerances.

The frames of the present invention also enable the easy and precise location at one time on the various cross slats, of all the cone springs needed in the entire box spring structure, the springs being in rows spaced apart the same equal or unequal distances as the cross slats are spaced. Optionally, instead of a complete sub-assembly of springs being attached to the cross slats, each slat may, before being set into its place in the frame, be provided with its row of springs to form a partial sub-assembly, or individual springs may be attached singly to the slats after the frame has been completely assembled.

The additional advantages mentioned have been attained by the use, in a box spring structure, of a frame preferably but not necessarily comprising side and end rails of rectangular cross section each having a wide face thereof uppermost, the side rails being substantially the overall length of the structure, the end rails being substantially the overall width of the structure and each arranged underneath and across the side rails with the end portions of the upper wide face thereof coplanar with and in secured overlapping corner engagement with the respective adjacent end portions of the lower wide faces of the side rails, the frame including a multiplicity of substantially parallel cross slats of rectangular cross section on top of and in secured engagement with the upper wide faces of the side rails, the end slat at each end of the frame being directly underneath the end row of springs intended to be carried thereby, each end slat being in upward and inward spaced relation to the adjacent end rail and being securely connected thereto by a longitudinal brace having each end part thereof inserted between the end slat and the end rail adjacent thereto and forming therewith the end structural unit hereinbefore mentioned, the upper member of the unit being the end slat, the lower member being the end rail and the connecting member being the brace, and a filler strip of rectangular cross section secured to the lower face of each of the side rails and being coplanar with and extending longitudinally between the end rails.

The frames consisting of the rails, cross slats, filler strips and longitudinal brace are assembled in upside down position without rehandling and are then righted by inversion for the attachment thereto of the springs, if such springs have not been previously attached and for upholstering.

Some of the various forms the invention may take are disclosed in the following description and are shown in the drawings, in which FIG. 1 is a top plan view of about one half of a complete box spring frame for economy of illustration, the other half being the same and showing the cross slats arranged vertically or edgewise.

FIG. 1*a* is a similar view foreshortened of a somewhat different form of the frame showing the slats lying horizontally or flatwise on the side rails.

FIG. 2 is a vertical sectional view of the box spring frame taken on the line 2—2 of FIG. 1.

FIG. 3 is a similar view taken on the line 3—3 of FIG. 1*a*.

FIG. 4 is a vertical sectional view taken on the line 4—4 of FIG. 1 but showing the cross slats somewhat shorter than in FIG. 1, in connection wiyh a narrower filler strip.

FIG. 5 is a similar view taken on the line 5-5 of FIG. 1 but showing a somwhat wider filler strip than in FIG. 1*a*.

FIG. 6 is a fragmentary vertical sectional view similar to FIG. 2 of the completely finished and upholstered box spring showing clip-anchored springs.

FIGS. 7, 8 and 9 are fragmentary top plan views of the frame showing steps in the frame-assembling operation and also showing in dash-dot lines the position of a spring at the end of a cross slat and on an intermediate part of an end slat.

FIG. 10 is a foreshortened end elevational view of a box spring structure embodying the complete frame of FIG. 1 and showing the structural unit formed by the longitudinal brace, the end slat and the end rail.

FIG. 11 is a diagrammatic top plan view of a single spring-carrying cross slat constituting a partial sub-assembly.

Herein, by the term "box spring" is meant the completely assembled and upholstered frame, box spring structure and upholstery. By "box spring structure" is meant the box spring without the upholstery. By "frame" is meant the rails, filler strips, cross slats and longitudinal brace.

In both forms of the invention shown in FIGS. 1 and 1*a*, only half of each form of a frame appears for economy of illustration. The half frame 11 is shown in FIG. 1 while another form 12 of the half frame is shown in FIG. 1*a*. The side rails 13 of both frames are of rectangular cross section. All of the rails are arranged flatwise, that is, with both wider and planar upper and lower faces thereof in a horizontal position. The inner edges of said side rails extend substantially the full overall length of the frame from one end to the other end. Each side rail provides an upper wide surface 14 for the support of the cross slats. A similar planar surface 15 on the under face of each side rail makes possible a completely overlapped lap joint 16 at each frame corner with an end portion of each end rail 17 or 18. In the frame 11, the cross slats 19 of rectangular cross section are positioned vertically or edgewise, by which is meant with the side faces thereof upright, while in the frame 12 the cross slats 20 are arranged flatwise, that is, with the respective wide faces thereof horizontal.

A relatively thin and narrow filler strip extending longitudinally between and coplanar with the end rails is secured to each of the side rails with its outer edge flush with the outer edge of the rail to which it is attached. The filler strip 21 is shown in frame 11 to be wider than the filler strip 22 of frame 12 to illustrate the wide range of tolerable dimensions possible. Each such strip transmits the weight of the load which is put on the side rail to the side rail of a suitable bed frame, not shown but on which it is intended to rest for most of its length.

A feature of the invention is the arrangement of the end rails relatively to the side rails. The end portions of said end rails 17 and 18 are positioned underneath the end portions of the side rails with the upper planar faces of the end rails in secured engagement with the under faces 15 of the side rails, as best seen in FIG. 6 and shown in inverted position in FIGS. 8 and 9. The end rails carry no springs and make possible adequately rigid corner lap joints. They also support and permit tacking thereto of the bottom portion of the side panel of the upholstery cover 23 (FIG. 6). Most important and as previously indicated, they form the lower members of the end structural frame units which enable the box spring to carry unusally heavy loads safely without increase in the amount or sizes of the material usually used in box spring frames. The end rails may be made as wide or as narrow as convenient, provided they be wide enough to overlap the side rails over a sufficient corner area to give the frame corners the necessary rigidity. They consequently are made the full overall width of the frame. The arrangement of the end rails completely under the side rails further permits shortening of the filler strips 21, 22 to a length less than the distance between the inner edges of the end rails as shown in FIGS. 2, 3, 6 and 9. Such shortening compensates inexpensively for the significant dimensional variations which must be tolerated in low cost wooden structures to avoid the cost and extra material required for hand fitting of such parts. The end rails are coplanar with the filler strips and cooperate therewith to form a smooth bottom surface on the frame and box spring. At the corner joints 16, the secured side and end rails are preferably rounded by curves having a radius not greater than the width of the narrower of either rail to ensure against undesirable shortening of either rail and consequent reduction of the area of the lapped joints.

As shown, the slats 19 and 20 do not extend completely across the frame, nor need all the slats in a frame be the same length. Considerable tolerances in length are allowable in view of the planar and wide upper surfaces on the side rails which can receive a substantial range of slat lengths efficiently. Although FIG. 1 shows the slats 19 overhanging the relatively wide filler strip 21, said slat may be considerably shorter as shown in FIG. 4 in connection with a narrow filler strip 22 with resulting appreciable economy of material. The strip 22 is also illustrated as narrower than the strip 21 to demonstrate the range of slat lengths and filler strip widths available to meet special conditions. In all cases, however, the outer edges of the filler strips are flush or coplanar with the outer edges of the respective side rails to ensure correct upholstering of the cover material. Said material is suitably attached to the box spring structure as by tacking or the like.

As shown in FIG. 6 the end slats 19a or 19b at each end of the respective frames 11 or 12 are at the proper distance from the adjacent end rail 17 or 18 to arrange the top coils 24 and border wire 25 of the row of springs 26 intended to be carried by each of said end slats, in the correct position for upholstering as by the padding 27 and the top cover panel 28 when the box spring is finished. The end slats may overhang the end rails to some extent as in FIGS. 1 and 1*a* or may not so overhang as in FIGS. 5 and 7–9 depending on the width selected for said end rails to attain adequate corner joints and to form the required structural units.

The slats are preferably, though not necessarily, spaced apart equal distances throughout the box spring structure. In any case, whether the spacing between slats in the same throughout or not, such spacing is determined by the spacing between the transverse rows of springs in the particular subassembly intended to rest on the slats; that is, the spacing between slats, whether equal or unequal, is the same as the spacing between said rows of springs. In view of such similar spacing between the rows of conical coil springs and of the slats, whatever such spacing may be, one is assured that the bottom coils of the springs in a sub-assembly such as 30 (FIG. 10) in which only the top coils of the springs are tied together, are properly centered directly on the top surfaces of their respective slats. Bottom coil tying wires may also be employed, of course, if the advantages justify the expense thereof, under certain circumstances. The sub-assembly, of whatever form, is secured to the finished frame after the frame has been assmbled.

In the sub-assembly 30 of FIG. 10, staples 31 are shown securing the bottom coils of the springs to the tops of the slats. In FIG. 5, the U-shaped wire anchoring clip 35 is the spring attaching means. Such anchoring clip is also employed should the edgewise disposed slats all be of uniform height to fit the clip or should it be desired to use only sub-assemblies as shown in FIG. 11 (partial subassemblies) in which each individual slat is supplied with its row of springs before being incorporated into the box spring frame. Tangent tying wires 32 are fastened to the top coils of the springs 26 for the slat 19 by the clips 33. The pre-assembly of a row of springs for each slat is suggested by the dash-dot circles of FIG. 9. The partial sub-assemblies 37 are nestable with each other to economize in space for shipment and storage. Though the springs 26 are centered on the various slats, those on the end slats overhang the respective end rails enough to position them properly for upholstering (FIG. 9).

As shown in FIGS. 7, 8 and 9, the frame is assembled in upside down position. The slats 19 and 19*a* (FIG. 7) for example, are first spaced apart the required distances parallel to each other and in edgewise position. The side rails 13 are then placed flatwise on top of the respective end portions of the slats and suitably secured thereto as by stapling or nailing and glueing, the fastener being driven downwardly first through the side rail and then deeply into the slat. The flatwise arranged side rail being of little height or thickness compared to the width or height of the edgewise arranged slat, the fastener passes quickly and easily through the side rail and firmly into the slat without the need to reduce the effective height of the slat be removal of corner material thereof. In addition, dangers of splitting the end of the slat and insufficient grip on the side rail are obviated.

To form the end structural units, a center or longitudinal brace is required for the slats especially in the various larger than single sized widths of box springs, in distinction from corner braces which are not here required. The longitudinal brace 36 (FIGS. 1, 1*a* and 10) is secured on to the tops of the slats at the time that the side rails are so secured. The brace need not be as long as the side rails but is long enough to reach the later set end rails and to be fastened thereto and to brace them. The brace is therefore coplanar with the side rails. The end rails 17 of the desired width and thickness are then set on top of the side rails and of the brace ends and secured therto. The corner lap joints 16 thus formed are fastened in a similar manner (FIG. 8). The respective filler strips 21 or 22 are similarly secured on top of the side rails between the inner edges of the end rails with the outer edge of each strip flush with the outer edge of its side rail and coplanar with the end rails. The finished frame 11 or 12 is then inverted into its right side up position and the sub-assembly 30 or partial sub-assembly 37 of springs of whatever type, secured thereto, is springs have not previously been secured to the slats, thereby to complete the box spring structure. Finally, the structure is upholstered.

It will now be understood that the novel arrangement, end structural units and relative proportions of the frame parts make possible considerable economies in labor and materials as well as an efficient method of making box springs without loss of strength or efficiency and that the frames disclosed are such as can be employed for making a variety of spring structures and box springs some of which have been described and that the objects of the invention have been adequately attained.

We claim:

1. In a box spring having a box spring structure comprising a frame including side rails, an end rail at each end of the frame and cross slats extending between the side rails and means for forming a self-reinforcing structural unit with spaced apart members at each end of the frame connected together to cooperate in mutually transferring stresses therebetween and adequate to support concentrated loads on relatively small areas at the end portion of the box spring, said means comprising a longitudinal brace adapted to support all of the slats, the upper member of the structural unit being the end slat, the lower member of the unit being the end rail and the member connecting the end slat and the end rail being an end portion of the brace, said end portion having a lower surface in secured engagement with the upper surface of the end rail adjacent thereto, said portion having an upper surface in secured engagement with the lower surface of the end slat adjacent thereto, said end slat forming a support for the bottom coils of an end row of coil springs at the end portion of the box spring, the width of said upper surface of the end slat being sufficient to arrange said end row of springs in the proper position for upholstering.

2. The box spring of claim 1, and a filler strip of rectangular cross section secured to the lower face of each of the side rails and being coplanar with and extending longitudinally between the end rails, and the upright side edge of the filler strip for each side rail being flush with the outer side edge of said side rail, the length of each filler strip being not greater than the distance between the inner edges of the end rails.

3. The box spring of claim 1, the wider faces of the slats being upright, the upper faces of the side rails and end rails being planar throughout the entire widths of said rails and fasteners passing upwardly completely through the side rails and into the slats.

4. In the box spring of claim 1, a row of cone springs centered on each slat and means securing the lowermost coil of each spring to the upper face of each slat, the end rails being devoid of springs.

5. In the box spring of claim 1, the longitudinal brace being coplanar with and substantially parallel to the side rails and extending across substantially the length of the frame, the end slats being sufficiently wide to extend inwardly of the end rails.

6. The method of making the box spring of claim 1 comprising aligning a number of slats in substantially parallel relation, securing a side rail on and across the corresponding top end portions of said slats, securing and overlapping an end rail on the top end portion of each side rail, securing a filler strip on top of each side rail between the end rails, securing the end portions of a longitudinal brace to the top portions of the end slats while maintsining said brace parallel to and between said side rails and coplanar with said filler strip, and turning the resulting frame into right side up position for further operation thereon to complete the box spring.

7. The box spring making method of claim 6 and attaching rows of springs to the tops of the slats when the frame is right side up.

8. The box spring making method of claim 6, securing the bottom coils of a number of cone coil springs to each slat to form a partial sub-assembly comprising a slat and a row of springs, tying the top coils of the springs in each row together and inverting the spring-carrying slats prior to securing the side rails to the slats.

9. The box spring of claim 1, the side rails, end rails, slats and brace each being of rectangular cross section and having an upper face and a lower face completely planar across the entire widths thereof, the inner edges of the side rails being the full overall length of the frame, the inner edges of the end rails being substantially the full overall width of the frame, each of the end rails being arranged completely underneath the side rails with an end portion of the entire upper planar face thereof coplanar with and in secure overlapping corner engagement with the respective end portions of the lower faces of the side rails, each cross slat being intended to carry a row of cone springs centered thereon, each end slat being in upward and inward spaced relation to the end rail adjacent thereto and a filler strip of rectangular cross section secured to the lower face of each of the side rails and coplanar with and extending longitudinally between the end rails with the outer upright edge thereof coplanar with the outer upright edge of the side rail to which said strip is secured, the length of each said strip being not greater than the distance between the inner edges of the end rails.

10. The box spring of claim 9, the slats being arranged edgewise on the side rails and staples passing upwardly completely through the side rails and deeply into the end portions of the respective slats.

11. The box spring of claim 9, the slats being arranged flatwise on the side rails and staples passing upwardly completely through the side rails and into the end portions of the respective slats.

12. The box spring of claim 9 having the frame made according to claim 6.

* * * * *